US006712082B2

(12) United States Patent
Crane et al.

(10) Patent No.: US 6,712,082 B2
(45) Date of Patent: Mar. 30, 2004

(54) KITCHENWARE WASHING APPARATUS

(75) Inventors: David R. Crane, Waukesha, WI (US); Michael H. Belleville, Placentia, CA (US)

(73) Assignee: JohnsonDiversey, Inc., Sturtevant, WI (US)

( * ) Notice: Subject to any disclaimer, the term of this patent is extended or adjusted under 35 U.S.C. 154(b) by 173 days.

(21) Appl. No.: 09/860,859

(22) Filed: May 18, 2001

(65) Prior Publication Data

US 2002/0170584 A1 Nov. 21, 2002

(51) Int. Cl.[7] ..... B08B 3/02
(52) U.S. Cl. ..... 134/108; 134/186; 134/198
(58) Field of Search ..... 134/171, 180, 134/181, 201, 64 R, 122 R, 199, 186, 105, 107, 108, 200, 115 R; 312/222

(56) References Cited

U.S. PATENT DOCUMENTS

| | | | | |
|---|---|---|---|---|
| 946,175 | A | * | 1/1910 | Walton Jr. |
| 1,340,852 | A | * | 5/1920 | Neilsen |
| 1,542,292 | A | * | 6/1925 | Eddy |
| 1,804,715 | A | * | 5/1931 | Tafel, Jr. |
| 1,995,331 | A | * | 3/1935 | Snyder et al. |
| 2,353,993 | A | * | 7/1944 | Cavicchioli |
| 2,480,931 | A | * | 9/1949 | Jaeger |
| 2,737,040 | A | * | 3/1956 | Anderson |
| 2,749,734 | A | * | 6/1956 | Dye |
| 2,889,559 | A | * | 6/1959 | Lyon, Jr. |
| 2,912,988 | A | * | 11/1959 | Kochendorffer |
| 3,108,754 | A | * | 10/1963 | Low et al. |
| 3,240,171 | A | * | 3/1966 | Hatac |
| 3,358,702 | A | * | 12/1967 | Schaap |
| 3,717,159 | A | * | 2/1973 | Caviccioli |
| 3,863,657 | A | * | 2/1975 | Irving |
| 4,776,359 | A | * | 10/1988 | Federighi, Jr. et al. |
| 5,934,298 | A | * | 8/1999 | Singh |

FOREIGN PATENT DOCUMENTS

| | | | |
|---|---|---|---|
| DE | 3900617 | * | 7/1990 |
| DE | 297 06 153 | * | 7/1997 |
| FR | 2530326 | * | 1/1984 |
| JP | 54-88665 | * | 7/1979 |
| JP | 57-41585 | * | 3/1982 |
| JP | 2-88098 | * | 3/1990 |
| JP | 11-128147 | * | 5/1999 |
| JP | 2000-279678 | * | 10/2000 |

OTHER PUBLICATIONS

European Patent Application 1,029,501 Aug. 2000.*

High Temperature Dishmachines Flyer, by CMA Dishmachines, A S. C. Johnson Professional Company, 2 pages, admitted prior art.

* cited by examiner

*Primary Examiner*—Frankie L. Stinson
(74) *Attorney, Agent, or Firm*—Neil E. Hamilton; Warren R. Bovee; Renee J. Rymarz

(57) ABSTRACT

A kitchenware washing apparatus has a wash tank and a heated tank connected in a manner that they have a common wall for maximum water heating efficiency. In a preferred manner, the common wall has a tiered configuration. A particle accumulator is positioned inside a cabinet of the apparatus and in a flow path of the overflow drain water from the wash tank.

7 Claims, 9 Drawing Sheets

LEFT SIDE

RIGHT SIDE

KITCHENWARE WASHING APPARATUS

BACKGROUND OF THE INVENTION

1. Technical Field

This invention relates generally to kitchenware washing apparatus and more particularly to kitchenware washing apparatus wherein energy consumption is reduced and the efficiency of wash cycles is increased.

2. Background Art

There are available a wide variety of kitchenware washing machines. A concern with many of the machines is the amount of energy required to heat wash and rinse water as well as to control the temperature of each. Another concern is the volume of scrap material which is not removed from the kitchenware before being placed in the machine. The scrap material can cause a drain to become clogged or accumulate in the machine.

Thus, there is a need for a kitchenware washing apparatus which reduces energy consumption and at the same time reduces problems associated with scrap material.

The objects of the invention therefore are:

a. Providing an improved kitchenware washing apparatus.

b. Providing a kitchenware washing apparatus which reduces energy consumption.

c. Providing a kitchenware washing apparatus wherein the rinse water temperature and wash water temperature can be controlled with a single heating element.

d. Providing a kitchenware washing apparatus which reduces problems associated with scrap and particle material.

e. Providing a kitchenware washing apparatus wherein a particle accumulator is located in a compact manner in the apparatus.

f. Providing a kitchenware washing apparatus of the foregoing type which is easily accommodated under a counter.

SUMMARY OF THE INVENTION

The foregoing objects are accomplished and the shortcomings of the prior art are overcome by the kitchenware washing apparatus of this invention which includes a cabinet having an interior for receiving the kitchenware. A fluid input member and a fluid output member are operatively connected to the interior of the cabinet for the delivery and removal of a cleaning fluid. A wash tank member has an open top and a heated tank member is operatively connected to the wash tank member.

In a preferred manner, the heater tank member and the wash tank member are constructed with a common wall and the common wall is a bottom wall of the wash tank member and a top wall of the heated tank member.

Also, in a preferred manner, the common wall has a tiered configuration.

In one aspect, there is present a scrap basket in the wash tank member for the collection of large pieces of material and a particle accumulator in a fluid connection with an overflow opening in the wash tank, the particle accumulator located inside a housing of the apparatus.

In another aspect, the particle accumulator member is defined by a slideable drawer with a perforated wall.

In still another aspect, the perforated wall of the slideable drawer is positioned at a bottom of the drawer.

These and still other objects and advantages of the invention will be apparent from the description which follows. In the detailed description below, a preferred embodiment of the invention will be described in reference to the full scope of the invention. Rather, the invention may be employed in other embodiments.

DESCRIPTION OF THE PREFERRED EMBODIMENT

Figure 1:
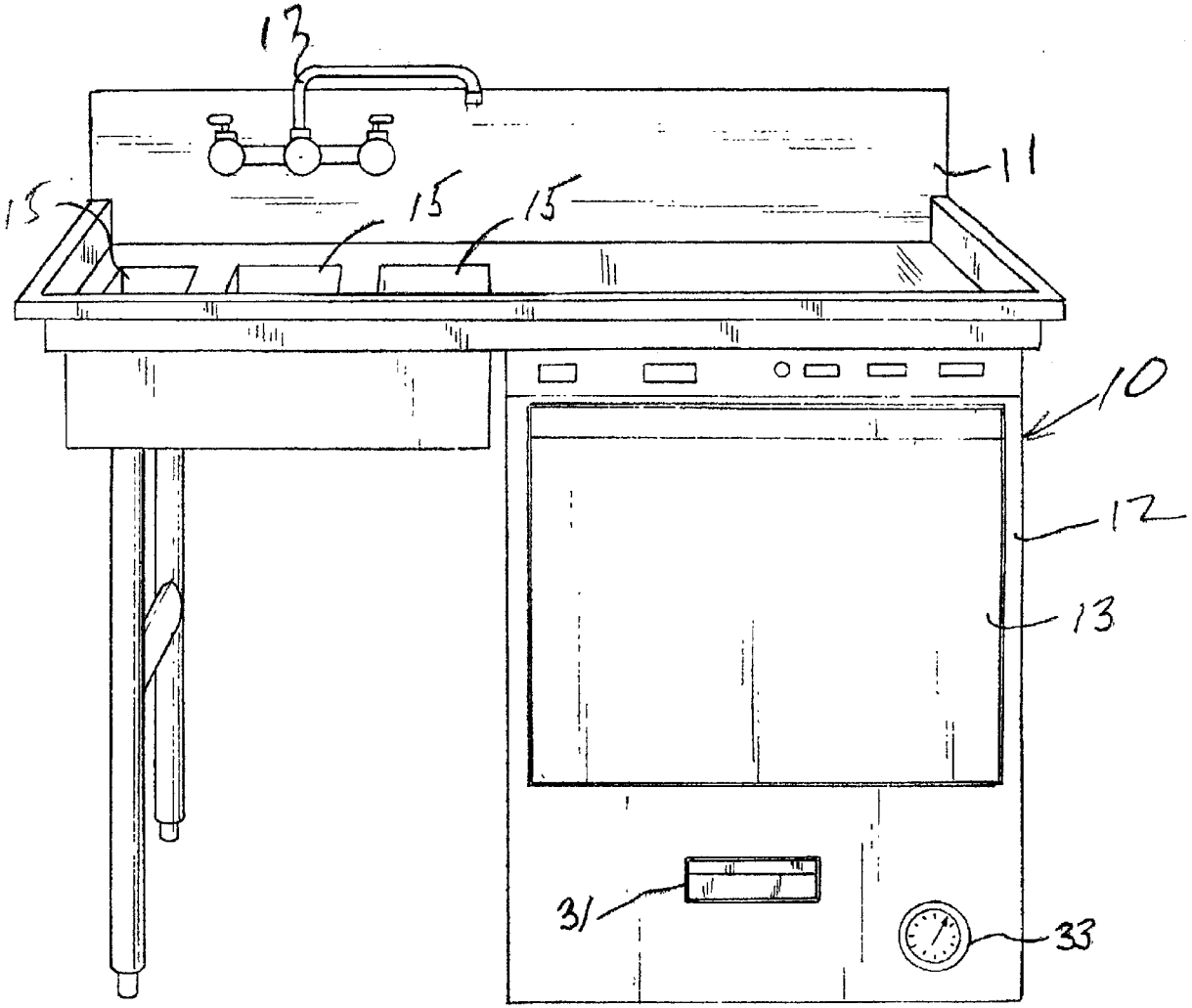
FIG. 1 is a perspective view of a dishwashing station showing the kitchenware washing apparatus positioned therein.

Referring to FIG. 1, the kitchenware washing apparatus generally 10 has a cabinet 12 providing an internal chamber into which kitchenware such as glasses and dishes are placed for washing. The washing apparatus 10 is dimensioned to be placed under a wash counter 11 having the usual basins 15 and faucet 17.

Figure 3:
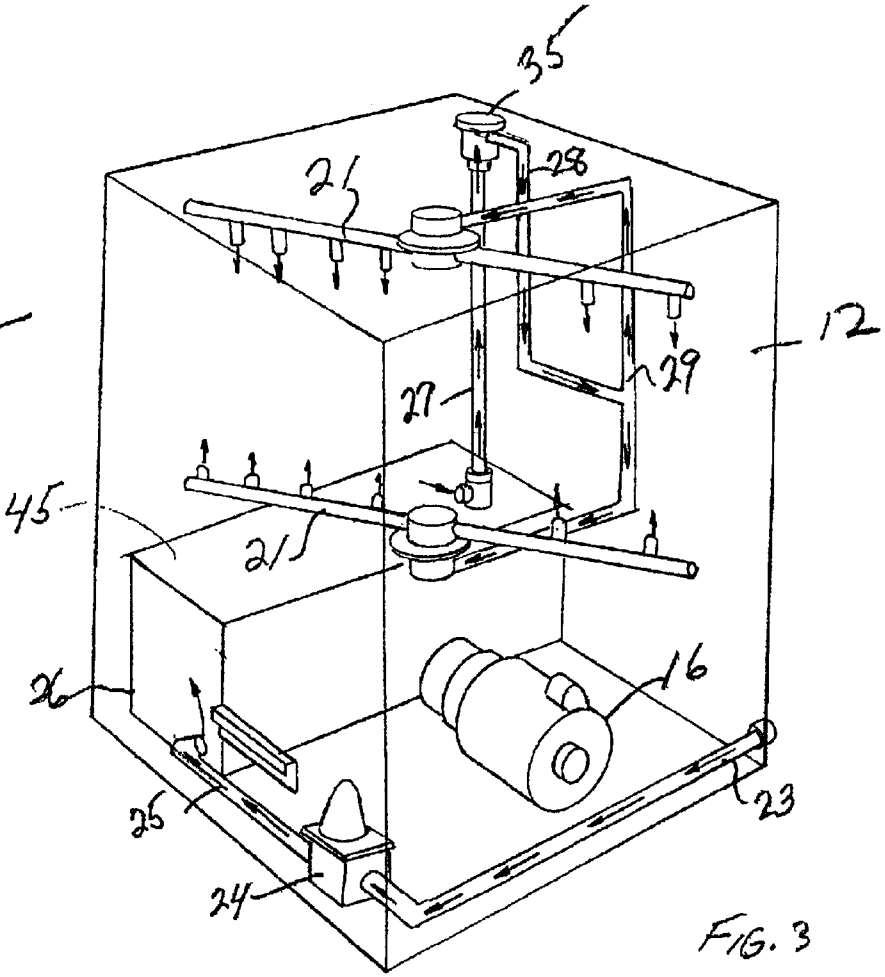
FIG. 3 is a view similar to FIG. 2 showing a rinsing function.
Figure 2:
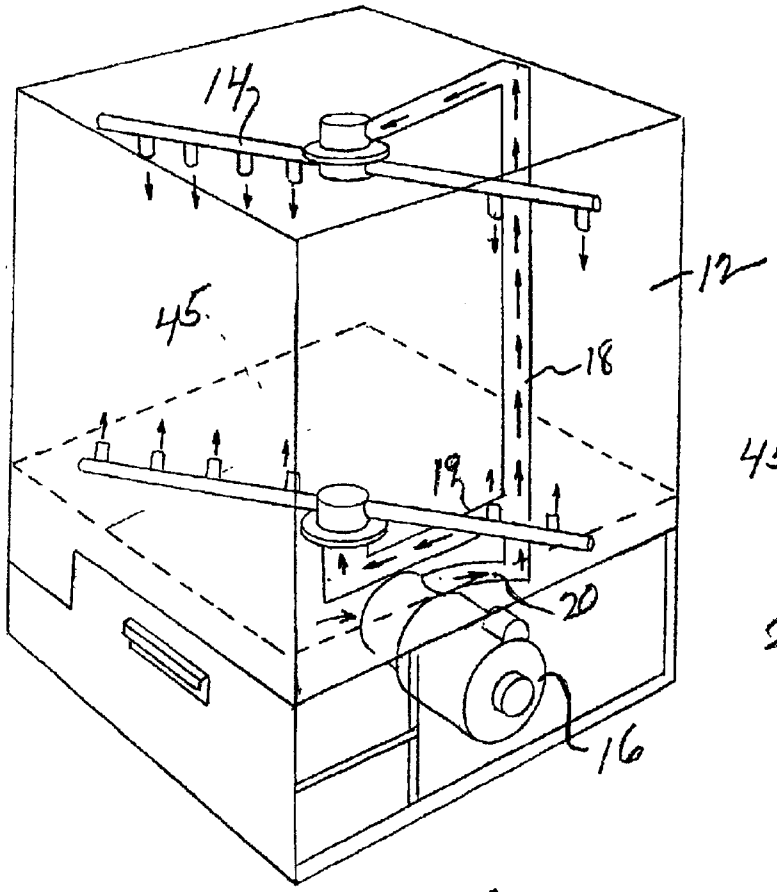
FIG. 2 is an isometric illustration of the kitchenware washing apparatus showing a washing function.

As seen in FIGS. 2 and 3, there are the wash arms 14 which are supplied with water from wash pump 16 by means of the lines 18 and 19 and the hose 20. Also in the chamber 12 are the rinse arms 21 which are supplied with water from the lines 28 and 29 as well as line 27 with line 27 being connected at one end to the heated tank member 26 and at the other end to the vacuum breaker 35. Water is supplied to the tank member 26 by means of lines 23 and 25 which are interconnected to a pressure regulator 24. Although not shown, kitchenware would be placed in the customary manner on racks supported on tracks so as to position the kitchenware between the wash arms 14 and the rinse or spray arms 21.

Figure 4:
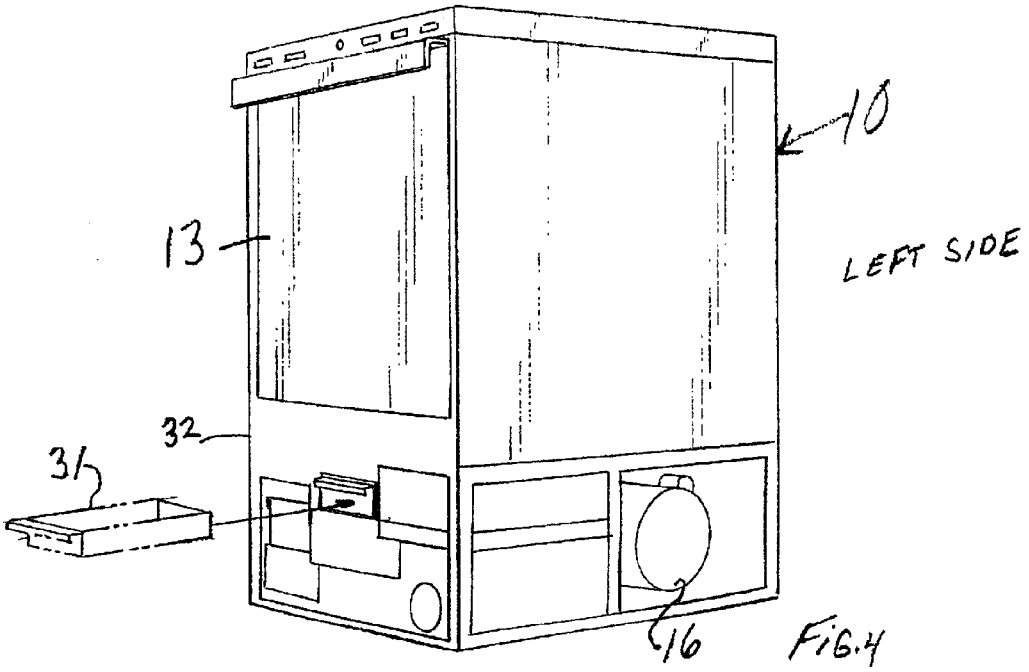
FIG. 4 is a perspective view of the kitchenware washing apparatus showing the left and front sides.
Figure 5:
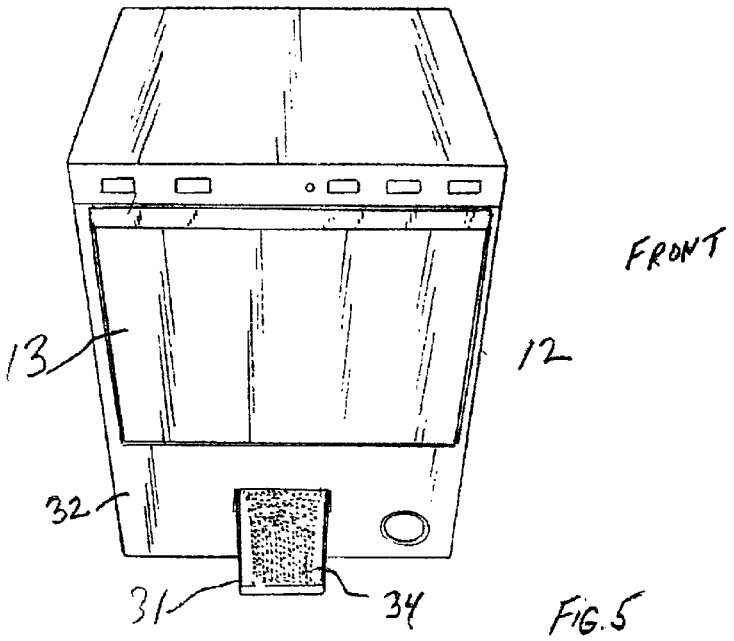
FIG. 5 is a top perspective view of the kitchenware washing apparatus.
Figure 6:
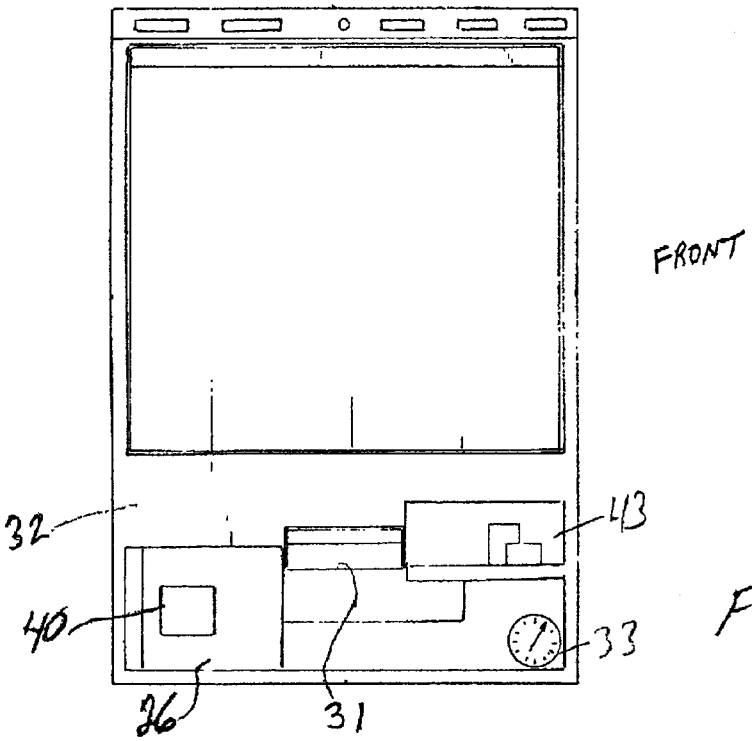
FIG. 6 is a front view of the kitchenware washing apparatus.

FIGS. 4, 5 and 6 show the particle accumulator 31 located inside the housing 32 of the washing apparatus 10. It is of a slidable and removeable drawer type with a perforated bottom well 34. See also FIG. 11.

Figure 7:
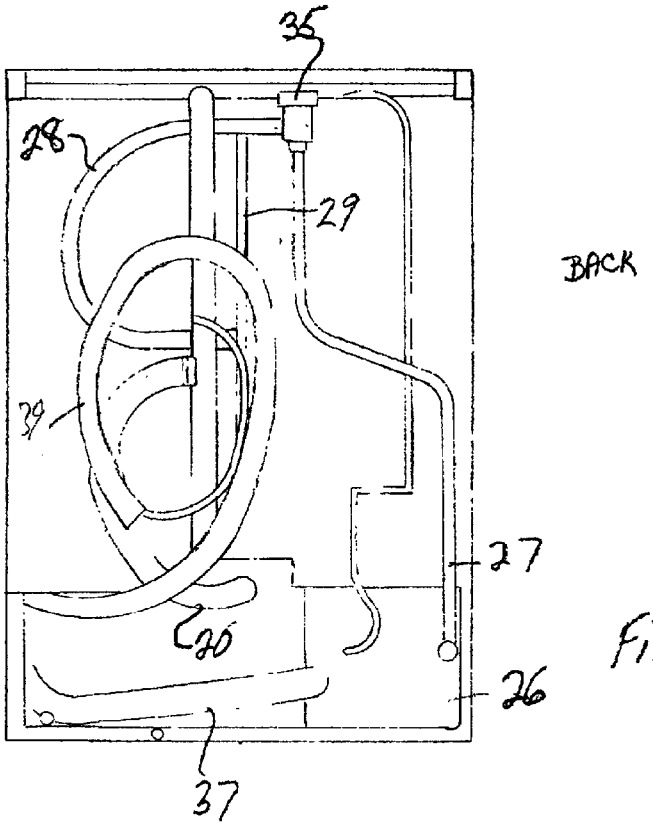
FIG. 7 is a back view of the kitchenware washing apparatus.
Figure 12:
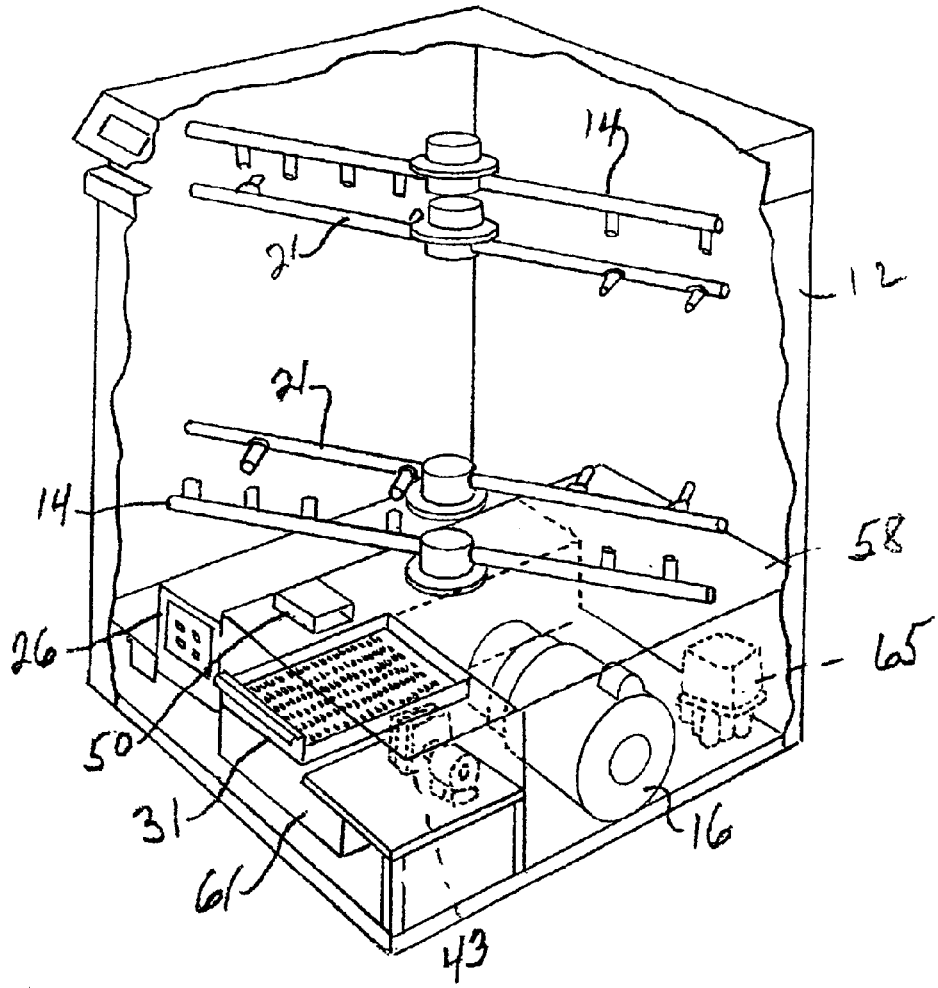
FIG. 12 is a view of the kitchenware washing apparatus with the cabinet broken away illustrating the internal components.

FIG. 7 illustrates the line and hose connections to the wash 14 and spray 21 arms as well as a drainage system which includes the drain hose 37 from the wash tank 45 as well as a drain hose 39 from the drain valve 65 (see FIG. 12).

Figure 8:
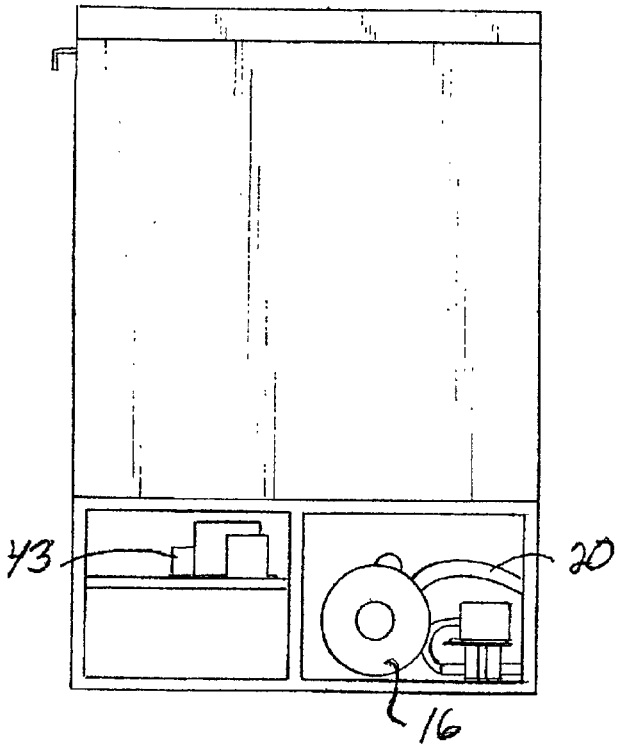
FIG. 8 is a left side view of the kitchenware washing apparatus.
Figure 9:
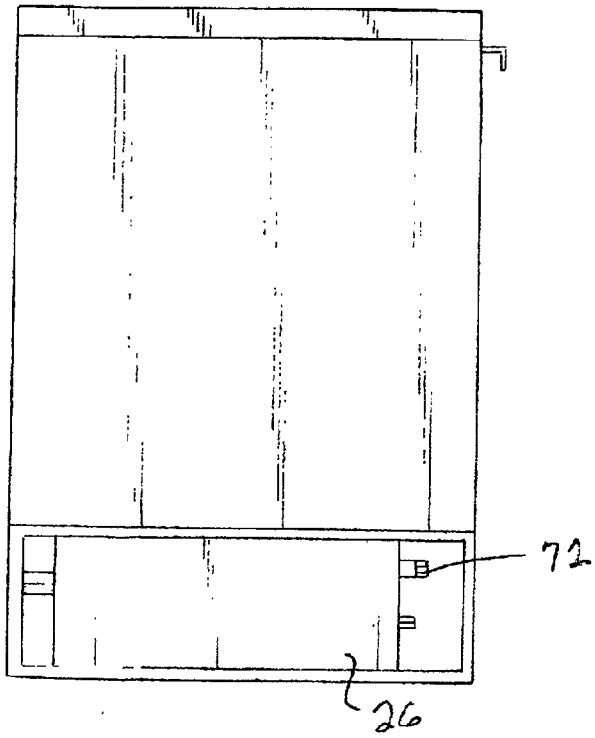
FIG. 9 is a right side view of the kitchenware washing apparatus.

FIGS. 8 and 9 illustrate opposite sides of the kitchenware washing apparatus where it is seen in FIG. 8 the wash pump 16 and the hose 20 for feeding water to the wash arms 14. In FIG. 9, which is the right side, there is seen at the bottom the heated tank member 26 as well as the thermostat temperature sensing element 72.

Figure 10:
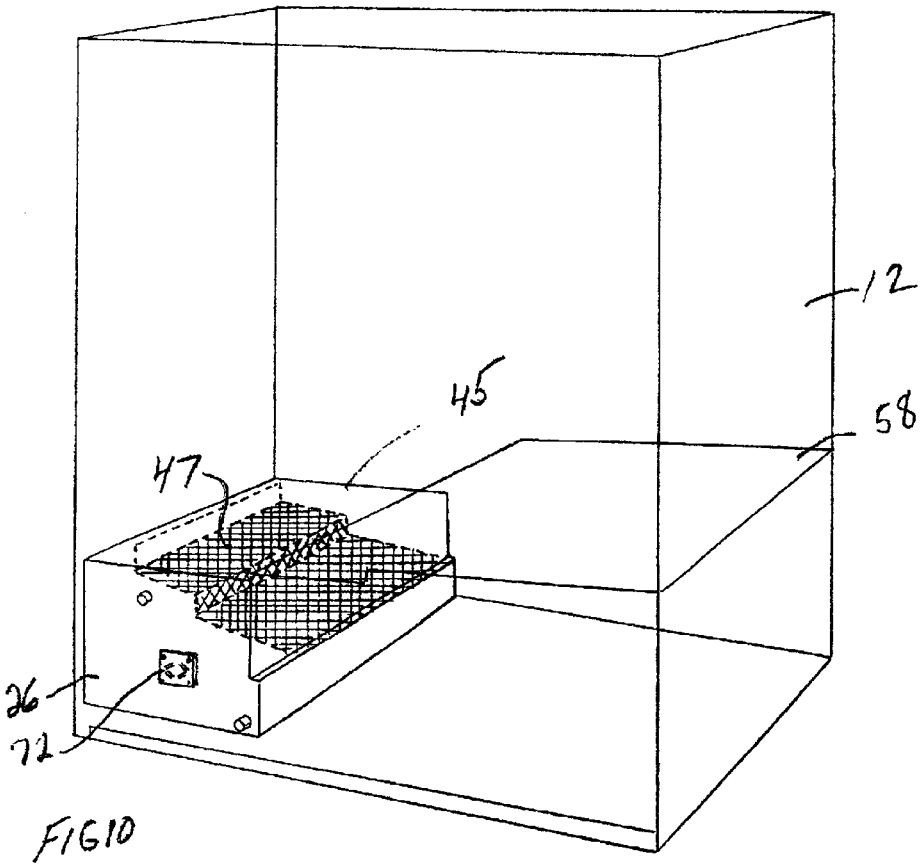
FIG. 10 is a perspective view showing the heater and wash tanks inside of the kitchenware washing apparatus.
Figure 13:
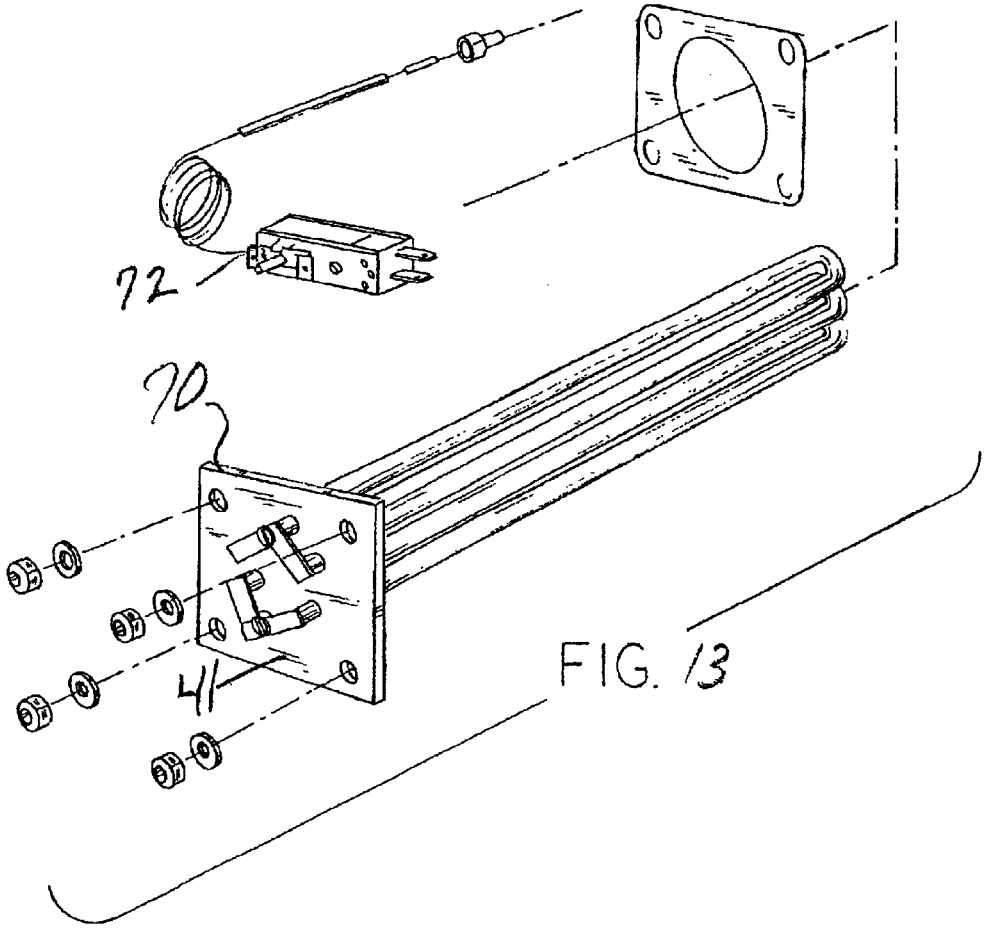
FIG. 13 is a perspective view of a heating element and thermostat.
Figure 14:
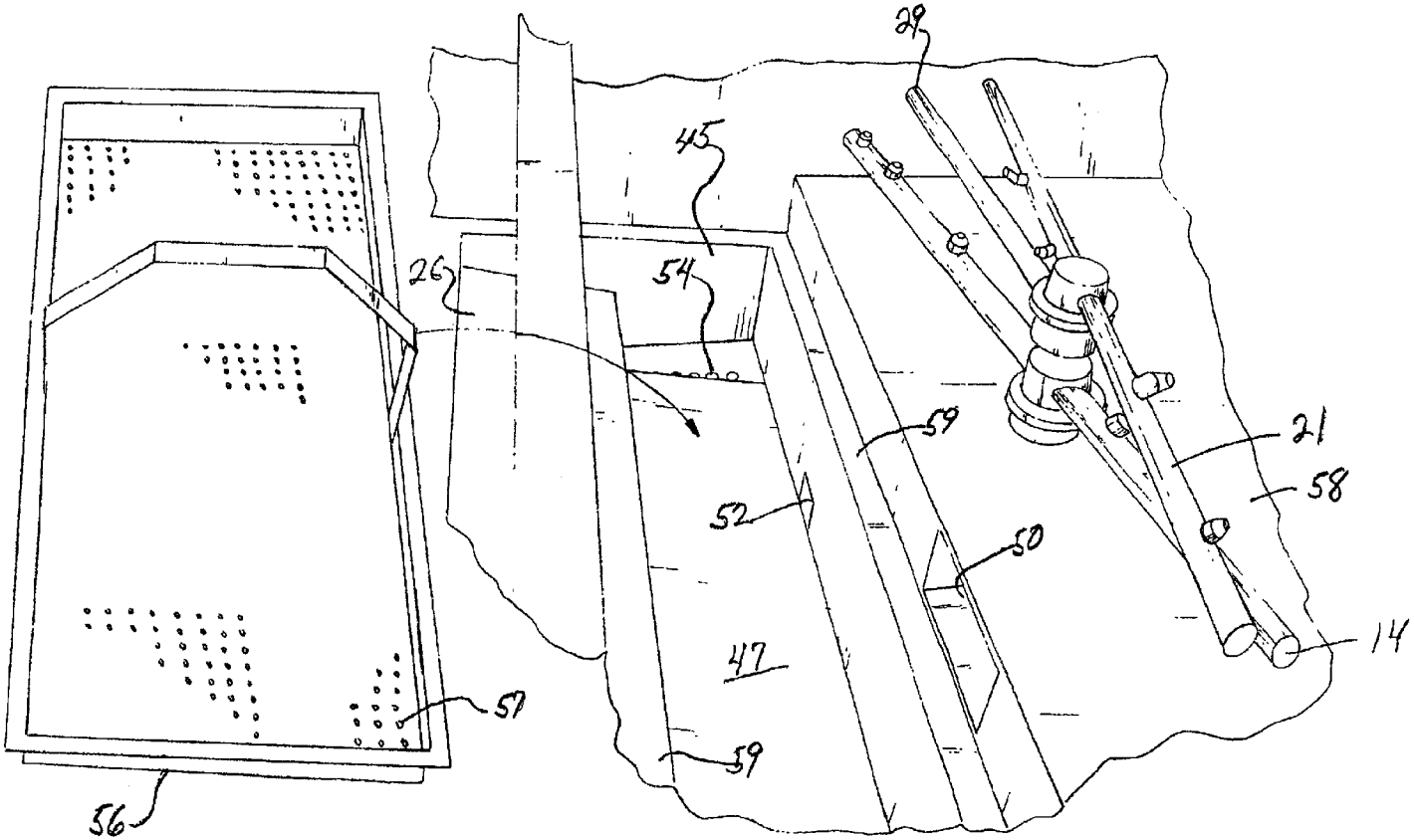
FIG. 14 is a fragmentary view showing the top of the wash tank and the placement of a scrap basket thereon.

FIGS. 10 and 14 show the heated tank member 26 and the wash tank 45. As seen in FIG. 10, a common wall 47 separates the two and provides a top wall for heated tank member 26 and a bottom wall for the wash tank 45. As seen in FIG. 13, a heater element 70 is shown. It is located in the heated tank member 26 for heating the water therein. It is regulated by the heater thermostat 72. There are also drain holes 54 in the common wall 47 which allows for drainage of the wash tank 45 such as by connection with drain hose 37 (see FIG. 7). The tiered wall 47 facilitates drainage of the tank 45.

Figure 11:
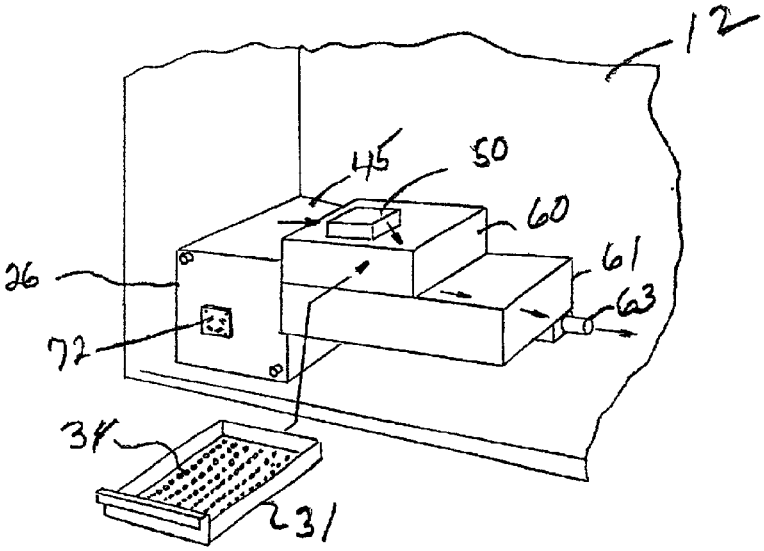
FIG. 11 is a diagrammatic view showing the passage of drain water from the wash tank.

FIG. 11 illustrates the overflow feature of the wash tank 45 into the drain system. As seen in FIG. 14 there is an overflow 50 near the top of the wash tank 45. This allows excess water to flow out of the tank and into the drain passages 60 and 61 where water will be conveyed by means of a hose connected to the hose connection 63 and ultimately to the drain valve 65. The pump inlet 52 is also shown for connection to the inlet of pump 16. A scrap basket 56 with a perforated bottom 57 is placed in the wash tank 45 and is positioned on flanged surfaces 59.

Referring to FIG. 12, there is seen the various components of the kitchenware washing apparatus with respect to each other. In this instance, the controls indicated at 43 are of the standard cam and contactor type for controlling the various valves, the heater and wash pump for introduction, heating and drainage of water from the various components as is customary in a kitchenware washing apparatus.

An important feature of the kitchenware washing apparatus is the common wall 47 between the heated tank member 26 and the wash tank 45. This allows the single heater element 70 to maintain heated water not only in the heated tank member 26 but also in the wash tank 45. Another important feature is the particle accumulator 31 in the housing of the washing apparatus. This allows for a compact design of the washing apparatus for under the counter location.

Operation

A better understanding of the kitchenware washing apparatus will be had by a description of its operation with particular reference to FIGS. 2 and 3. The heated tank member 26 is filled with line pressure water such as by introducing water through the lines 23, 24 and 25. The wash tank 45 is filled by introducing water into the rinse arms 21 from which water will flow into the wash tank 45. Once these two tanks are filled with water, the wash cycle is ready to begin. Wash pump 16 will be activated which will pump water from the wash tank 45 by means of inlet 52 into the lines 18 and 19 so as to cause water to flow from the wash arms 14 and over the dishware. The wash water will flow back into the wash tank 45. The preferred wash cycle is 94 seconds and will recycle approximately 59 gallons of water through the wash arms and back into the wash tank. The next cycle is a preferred 16 second rinse cycle which allows about 0.86 gallons of fresh water with a temperature of a minimum of 180° F. from the heated tank 26 to flow out the rinse arms 21. Fresh water should have a temperature of 140° F. when it is placed in the heated tank 26. The fresh water will flow from the rinse arms 21 from the heated tank member 26 to flow over the kitchenware and down into the wash tank 45. This supplies fresh water to the wash tank 45. It also will effect an overflow condition in the wash tank 45 and thereby remove any particulate matter to flow out of the overflow 50 and into the particle accumulator 31 where it can be removed. It will also be appreciated that during the previous description of the flow of water back into the wash tank 45 that any heavy material such as large pieces of food or even pieces of china from the dishware will be retained on the scrap basket 56 in the wash tank 45.

The unique combined wash tank member and heated tank member have been described for operation with an overflow system. It is obvious that it could be used in a kitchenware washing apparatus where an overflow system is not employed. Further, where the kitchenware washing apparatus is preferably used for an under the counter kitchenware washing machine, it can be utilized in one that is above the counter. This invention is therefore not to be limited except as set forth in the following claims.

What is claimed is:

1. A kitchenware washing apparatus comprising:

a cabinet having an interior for receiving the kitchenware;

a fluid input member and a fluid output member operatively connected to the interior of the cabinet for the delivery and removal of a cleaning fluid;

a wash tank member having an open top; and a heated tank member positioned adjacent to the wash tank member, the wash tank member and the heated tank member connected directly to wash and rinse arms;

the heated tank member including a heating member, the heated tank member and the wash tank member being constructed with a common wall, the common wall constructed and arranged to transmit heat from the heated tank member to the wash tank member.

2. The kitchenware washing apparatus as defined in claim 1 wherein the common wall is a bottom wall of the wash tank member and a top wall of the heated tank member.

3. A kitchenware washing apparatus comprising:

a cabinet having an interior for receiving the kitchenware;

a fluid input member and a fluid output member operatively connected to the interior of the cabinet for the delivery and removal of a cleaning fluid;

a wash tank member having an open top; and a heated tank member positioned adjacent to the wash tank member, the heated tank member including a heating member, the heated tank member and the wash tank member being constructed with a common wall, the common wall having a tiered configuration.

4. The kitchenware washing apparatus as defined in claim 1 wherein the wash tank member is constructed and arranged with an overflow opening in a side wall to provide an overflow capability.

5. The kitchenware washing apparatus as defined in claim 4 further including a scrap accumulator member operatively connected to the open top of the wash tank, the scrap accumulator having a flow path therethrough, and a particle accumulator member in fluid communication with the overflow opening in the wash tank, the particle accumulator located inside a housing of the apparatus.

6. The kitchenware washing apparatus as defined in claim 5 wherein the particle accumulator member is defined by a removeable drawer with a perforated wall.

7. The kitchenware washing apparatus as defined in claim 6 wherein the perforated wall is positioned at a bottom of the drawer.

* * * * *